US008733673B2

(12) United States Patent
Teerman et al.

(10) Patent No.: US 8,733,673 B2
(45) Date of Patent: May 27, 2014

(54) ELECTRONIC UNIT INJECTOR

(75) Inventors: Richard F. Teerman, Folly Beach, SC (US); Jerry A. Jones, Ravenna, OH (US)

(73) Assignee: Buescher Developments, LLP, Cleveland, OH (US)

( * ) Notice: Subject to any disclaimer, the term of this patent is extended or adjusted under 35 U.S.C. 154(b) by 416 days.

(21) Appl. No.: 13/188,505

(22) Filed: Jul. 22, 2011

(65) Prior Publication Data

US 2013/0020412 A1 Jan. 24, 2013

(51) Int. Cl.
*B05B 1/30* (2006.01)

(52) U.S. Cl.
USPC ..... 239/533.12; 239/585.5

(58) Field of Classification Search
CPC ..... B05B 1/30; B05B 1/3046
USPC ..... 239/88, 281, 585.1, 585.5, 584, 533.9, 239/533.12; 123/467, 506
See application file for complete search history.

(56) References Cited

U.S. PATENT DOCUMENTS

| | | | | |
|---|---|---|---|---|
| 1,873,782 | A | 8/1932 | Nixon | |
| 2,144,861 | A | 1/1939 | Truxell, Jr. | |
| 2,144,862 | A | 1/1939 | Truxell, Jr. | |
| 2,320,913 | A | 6/1943 | Crowell | |
| 2,569,233 | A | 9/1951 | Dickson et al. | |
| 2,576,451 | A | 11/1951 | Dickson et al. | |
| 2,591,401 | A | 4/1952 | Camner | |
| 2,686,503 | A | 8/1954 | Reddy et al. | |
| 2,740,667 | A | 4/1956 | Dickson et al. | |
| 2,898,051 | A | 8/1959 | Teichert | |
| 3,403,632 | A | 10/1968 | Hulsing | |
| 4,540,122 | A | 9/1985 | Teerman | |
| 4,568,021 | A | 2/1986 | Deckard et al. | |
| 4,741,478 | A | 5/1988 | Teerman et al. | |
| 4,790,731 | A | 12/1988 | Freudenschuss | |
| 5,328,094 | A * | 7/1994 | Goetzke et al. | 239/88 |
| 5,413,076 | A * | 5/1995 | Koenigswieser et al. | 123/446 |
| 5,797,427 | A | 8/1998 | Buescher | |
| 6,467,457 | B1 | 10/2002 | Lei et al. | |
| 7,073,730 | B2 * | 7/2006 | Haag et al. | 239/102.2 |
| 2003/0111560 | A1 * | 6/2003 | Bartkowiak et al. | 239/533.9 |
| 2010/0051723 | A1 * | 3/2010 | Jones | 239/533.2 |
| 2010/0115956 | A1 * | 5/2010 | Toon | 60/742 |

FOREIGN PATENT DOCUMENTS

| | | |
|---|---|---|
| FR | 803832 | 10/1936 |
| GB | 1180505 | 2/1970 |

* cited by examiner

*Primary Examiner* — Davis Hwu
(74) *Attorney, Agent, or Firm* — Pearne & Gordon LLP

(57) ABSTRACT

An electronic unit injector for a diesel engine that has a check valve for maintaining a pressure greater than vapor pressure and being located as close as practical to a plunger chamber to minimize fluid hammer effects on the check valve and has a fuel capture volume below the check valve that is proportioned to store sufficient static energy in compression of the captured fuel to reclose the check valve if opened by fluid hammer action.

8 Claims, 1 Drawing Sheet

ELECTRONIC UNIT INJECTOR

BACKGROUND OF THE INVENTION

The invention relates to improvements in electronic unit injectors for diesel engines.

PRIOR ART

Electronic unit injectors, well known in the art, inject diesel fuel into the combustion chamber of large diesel engines. Environmental concerns have increased the desire and need for more precise metering and timing of fuel delivery. Among other things, this has led to an increase in fuel injection operating pressures. These higher pressures can indirectly shorten the service life of an injector.

Cavitation can occur where pressure of fuel in the injector drops below vapor pressure. Cavitation can produce pitting of the internal parts of the injector, eventually shortening the injector service life due to fatigue failure or leakage. It is, therefore, desirable to avoid cavitation in a fuel injector. Variation in injection pressures in an injector can make fuel metering and timing difficult.

SUMMARY OF THE INVENTION

The invention provides an electronic unit injector with a check valve arrangement in a unique location and with a unique downstream volume that minimizes the risk of valve leakage. The check valve functions to maintain a pressure greater than vapor pressure in the lower end of the injector after injection and thereby reduces the risk of cavitation and improves the precision of fuel injection. The disposition of the check valve, according to the invention, reduces the potential for fluid inertial effects or fluid hammer, akin to "water hammer", to unseat the check valve. In accordance with the invention, the check valve is located as close as practical to the injection plunger to minimize the fluid hammer effect.

A relatively large volume capacity downstream of the check valve serves as an accumulator or energy storage site. The stored energy returns the check valve to its closed position in the event that the check valve is unseated, after first closing, by extraneous fluid hammer pressure waves occurring when injection is cut off. The check valve serves to keep the entire volume of fluid, in the so-called "stack" below the injector plunger, pressurized. This feature has the potential of improving accuracy of fuel metering and timing since the stack passages and nozzle cavity need not be completely re-pressurized before each injection event.

DESCRIPTION OF THE PREFERRED EMBODIMENT

Figure 1:
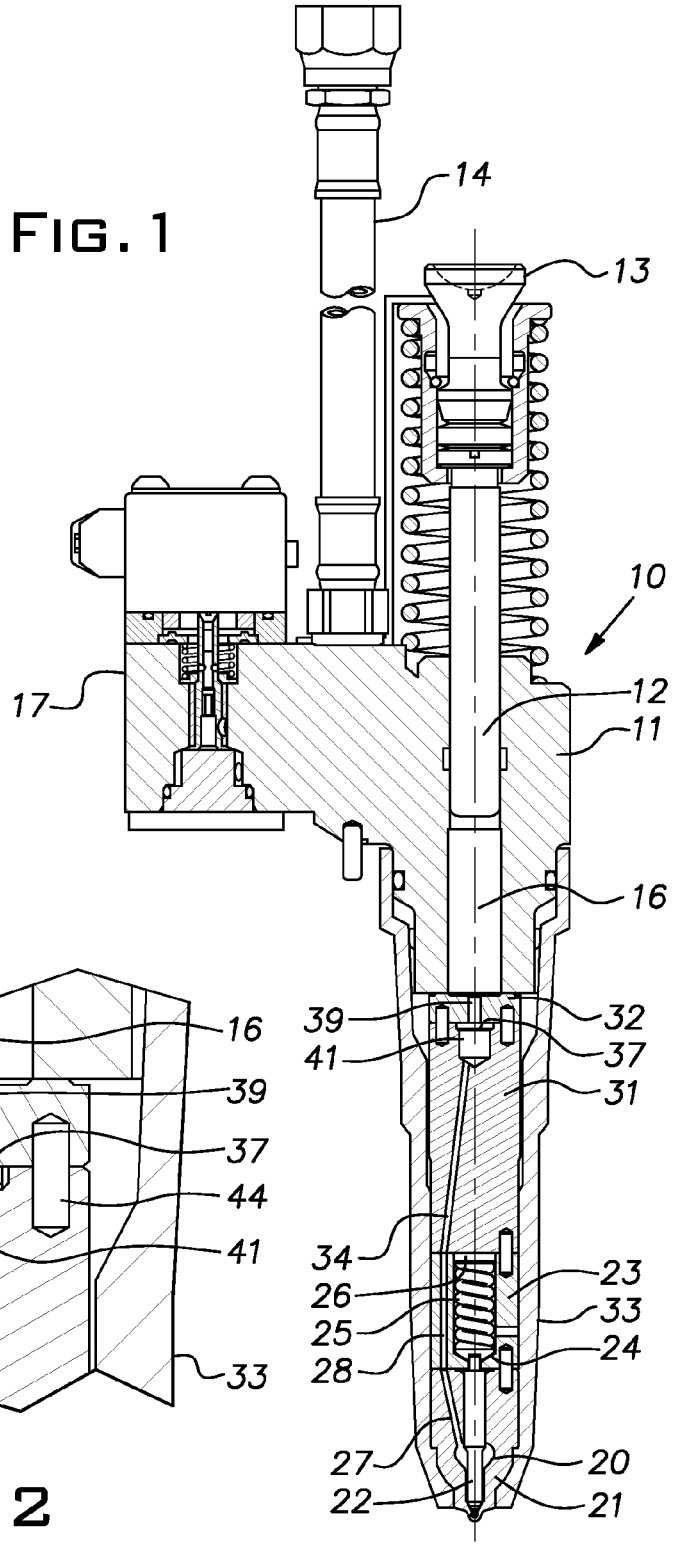
FIG. 1 is a cross-sectional view of an electronic unit injector taken in a vertical plane.
Figure 3:
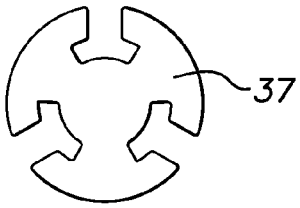
FIG. 3 is an axial view of the check valve.

FIG. 1 illustrates an electronic unit injector (EUI) configured to be used on an EMD 645 diesel engine manufactured by the Electro-Motive Diesel, Incorporated. The invention is useful in other injectors. Each cylinder of an engine has a separate EUI. The general arrangement and operation of this type of EUI is well-known in the industry. The EUI 10 includes a body 11 that houses a plunger 12. The plunger 12 is driven downwardly by a drive train (not shown) operating on a push rod adapter 13 when the engine rotates. Diesel fuel delivered to and re-circulated from the body 11 by external lines 14 is supplied to a chamber 16 in which the plunger 12 operates.

An electrically operated, electronically controlled control valve 17 spills fuel from the chamber 16 allowing it to be re-circulated unless fuel injection is occurring. During injection, the plunger 12 pressurizes fuel below it down through a "stack". The stack includes a spray tip 21 with a nozzle cavity 20 and a needle valve 22, and a spring cage 23 containing a spring seat 24, spring 25 and shim 26. The spray tip 21 and spring cage 23 have respective communicating aligned fuel passages 27, 28.

When fuel pressure developed by the plunger 12 delivered by the passages 27, 28 to the spray tip nozzle cavity 20, exceeds a certain value, the compression force of the spring 25 is overcome, the needle valve 22 is lifted and fuel is injected into the engine combustion chamber through holes in the spray tip 21.

In the space between the spring cage 23 and the body 11 are contained a check valve cage 31 and a spacer body 32. These elements, parts of the stack, are retained on the body 11 by a nozzle nut 33. The check valve cage 31 has a passage 34 aligned and communicating with the passage 28 in the spring cage 23.

At its upper end, the cage 31 has a counter bore 36 that receives a plate-like check valve 37. The counter bore 36 is deeper than the thickness of the check valve 37 so that during operation of the EUI 10, the check valve can move a limited distance away from and back against a lower face 38, serving as a seat for the check valve, of the spacer body 32. The check valve 37 moves axially to open or seal a central bore or flow passage 39 in the spacer body 32. The spacer body 32, which has the form of a flat disc with a diameter several multiples of its thickness, serves as a wall to close off the plunger chamber 16 while the central passage 39 communicates directly with the plunger chamber 16. The cage 31 is formed with a bore or cavity 41, below the counter bore 36.

Experience with prior art EUIs has revealed that cavitation can occur in the stack and particularly in the spring cage area. Cavitation can result in erosion or pitting of a part and ultimately its failure through fatigue. Design injection pressures have increased over time to improve emission performance with the result that the pressure swings in an EUI can be large, thus making precise metering and injection timing of fuel potentially more difficult.

The disclosed location of the check valve 37 as close as practical to the plunger chamber 16, while unconventional in an EUI, is advantageous because it limits potential "water hammer" or "fluid hammer" effects on the check valve. This effect can occur due to the momentum of the fuel flowing in the passage 39 upstream of the check valve 37. The fluid hammer effect in an EUI is typically much greater than what is experienced in a mechanical unit injector because the control valve operation is much faster than the port action in a mechanical unit injector. The spacer body or wall 32 must have some finite thickness to support the forces it sustains and, consequently, a fuel passage represented by the bore 39 must have a finite length but, in practicing the invention, this length should be minimized to the extent practical. The thickness of the illustrated spacer body 32 is required by locating pins 44 which might cause fatigue cracks if the body were made thinner.

If the spacer body 32 and/or nut 33 were modified so that the spacer body was laterally located by the nut, the pins 44 could be eliminated and the spacer body could be reduced somewhat in thickness. The ratio of the length of the wall passage 39 to its diameter, for good design, should be about 3 or less.

One aspect of the invention focuses on the volume of the space in which fuel is captured below the check valve 37. This below check valve space or volume (capture volume) is the sum of the volumes of the cavity 41 (less that occupied by the check valve 37), the passages 34, 28 and 27, and the nozzle cavity 20 (less that occupied by the needle valve 22), in which the check valve can potentially capture fuel. In accordance with the invention, this capture volume is sized such that the energy stored in the fuel by reason of its pressurization in this capture volume, is sufficient to adequately maintain the check valve 37 closed under normal operating conditions. This energy is used to instantaneously reclose the check valve 37 when the valve may be opened by a fluid hammer pressure pulse. As mentioned, such a pulse is generated by the kinetic energy of fuel flowing in the wall passage 39 immediately above the check valve at the instant the check valve closes. As indicated above, check valve closure is initiated by the spilling action of the control valve 17, and depressurization of fuel in the chamber 16 below the plunger 12.

The check valve capture volume is large enough so that it contains sufficient fuel and, therefore, energy at typical operating pressures, or slightly below, so that the captured pressure will reclose the check valve 37, cracked open by one or more subsequent fluid hammer pressure pulses, preferably without a substantial loss of pressure, i.e. a loss of more than about 30% of the peak-captured initial pressure. However, if the check valve 37 serves to positively retain any pressure, cavitation in the stack will advantageously be eliminated.

The capture volume can be determined by performing a one dimensional, dynamic, mechanical-hydraulic analysis with a computer program. In an EMD 645 diesel engine EUI where the passage 39 is nominally 0.300 inches long and 0.127 inches in diameter and the illustrated steel check valve 37 has a mass of 0.5 grams, the capture volume can be about 1.5 cc.

Figure 2:
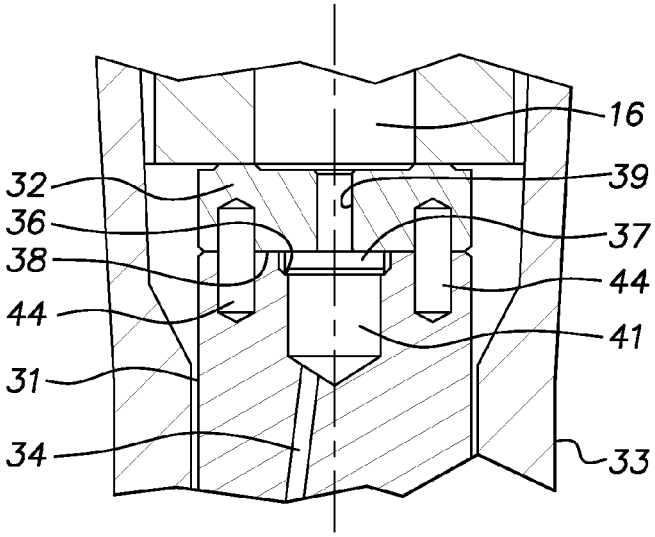
FIG. 2 is an enlarged view of a check valve and associated fluid pocket.

From the illustrated embodiment, it will be understood, for instance, by inspection at FIGS. 1 and 2, and consideration of the presence of the deep bore or cavity 41 in the check valve cage 31 that accommodates the check valve 37, the capture space is more than what is needed to channel fuel from the check valve to the nozzle cavity 20. The invention, thus, runs contrary to the accepted industry maxim that the trapped volume represented here by the capture volume and the passages between the plunger chamber and the control valve should be kept at a minimum. It should be realized that the deep cavity 41 can be omitted and its equivalent volume can be provided by enlarging a passage 34, 28 and/or 27 and/or the nozzle cavity 20.

To maintain injector efficiency, the capture volume should not exceed a calculated requisite volume by more than 50%.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An electronic unit injector having a spray tip with an internal valve seat, a needle valve in the spray tip, a spring cage surrounding a compression spring biasing the needle valve closed against the spray tip seat, a plunger operating in a chamber remote from the spring cage, a wall forming an end of the plunger chamber with a passage leading to an interior of the spray tip through passages in the spring cage and spray tip, wall receiving pins that laterally locate the wall, a plate type check valve adjacent an end of the wall passage allowing forward fuel flow from the plunger chamber through the wall passage to the spray tip cavity when open and stopping reverse flow into the wall passage when closed, an electrically operated control valve for selectively spilling fuel being displaced by the plunger at intervals between injection events, a ratio of the wall passage length to a cross section dimension of the wall passage being about 3 or less, whereby a fluid hammer effect of fuel in the wall passage on the check valve when the control valve opens to spill fuel in the plunger chamber is relatively small.

2. An electronic unit injector as set forth in claim 1, wherein said check valve seats against said wall.

3. An electronic unit injector as set forth in claim 2, wherein said wall is a circular body with a diameter several multiples of its thickness.

4. An electronic unit injector having a spray tip with an internal valve seat, a needle valve in the spray tip, a spring cage surrounding a compression spring biasing the needle valve closed against the seat in the spray tip, a plunger operating in a chamber remote from the spring cage, a wall forming an end of the plunger chamber with a passage leading to an interior of the spray tip through passages in the spring cage and spray tip, a plate type check valve adjacent an end of the wall passage allowing forward fuel flow from the plunger chamber through the wall passage to the spray tip cavity when open and stopping reverse flow into the wall passage when closed, an electrically operated control valve for selectively spilling fuel being displaced by the plunger at intervals between injection events, the length of the wall passage between the plunger chamber and the check valve seat being substantially smaller than half the distance of the check valve to the spring cage, whereby a fluid hammer effect of fuel in the wall passage on the check valve is limited.

5. An electronic unit injector having a spray tip with an internal valve seat, a needle valve in the spray tip, a spring cage surrounding a compression spring biasing the needle valve closed against the seat in the spray tip, a plunger operating in a chamber remote from the spring cage, a wall forming an end of the plunger chamber with a passage leading to an interior of the spray tip through passages in the spring cage and spray tip, a plate type check valve adjacent an end of the wall passage allowing forward fuel flow from the plunger chamber through the wall passage to the spray tip cavity when open and stopping reverse flow into the wall passage when closed, an electrically operated control valve for selectively spilling fuel being displaced by the plunger at intervals between injection events, a capture volume in which high pressure fuel is confined between the check valve and the needle valve being selected in consideration of wall passage cross-sectional area and length and mass of the check valve such that an opening of the check valve due to a fluid hammer effect in the wall passage is followed by a reclosing of the check valve from energy stored in the compression of fuel contained in the capture volume with a residual pressure being retained while excessive capture volume is avoided to maintain injector efficiency.

6. An electronic unit injector as set forth in claim 5, wherein the wall passage has a length from the plunger chamber to a check valve seat that is shorter than the distance of the check valve to the spring cage.

7. An electronic unit injector as set forth in claim 5, wherein a ratio of a cross section dimension of the wall passage to its length is ⅓ or more.

8. An electronic unit injector as set forth in claim 5, wherein the capture volume is sufficient to retain not less than about ⅔ of the pressure of the fuel when the check valve first closes.

* * * * *

UNITED STATES PATENT AND TRADEMARK OFFICE

CERTIFICATE OF CORRECTION

PATENT NO. : 8,733,673 B2
APPLICATION NO. : 13/188505
DATED : May 27, 2014
INVENTOR(S) : Richard F. Teerman et al.

It is certified that error appears in the above-identified patent and that said Letters Patent is hereby corrected as shown below:

On the title page item (73) Assignee: should read:

--Buescher Developments LLC, Cleveland, OH (US)--.

Signed and Sealed this
Twenty-sixth Day of August, 2014

Michelle K. Lee

Michelle K. Lee
*Deputy Director of the United States Patent and Trademark Office*